US006279484B1

(12) United States Patent
Shaw

(10) Patent No.: US 6,279,484 B1
(45) Date of Patent: Aug. 28, 2001

(54) ACTUATING MECHANISM FOR A TRANSIT VEHICLE GUIDE BEAM SWITCH

(76) Inventor: John B. Shaw, 1812 E. Marlette Ave., Phoenix, AZ (US) 85016

( * ) Notice: Subject to any disclaimer, the term of this patent is extended or adjusted under 35 U.S.C. 154(b) by 24 days.

(21) Appl. No.: 09/592,315

(22) Filed: Jun. 13, 2000

(51) Int. Cl.[7] ..... E01B 7/14

(52) U.S. Cl. ..... 104/130.01; 104/130.03; 104/130.09; 104/130.11; 104/178; 104/236

(58) Field of Search ..... 104/130.01, 130.03, 104/130.09, 130.11, 178, 236

(56) References Cited

U.S. PATENT DOCUMENTS

| | | | | |
|---|---|---|---|---|
| 2,925,875 | | 2/1960 | Bourdon . | |
| 3,021,796 | * | 2/1962 | Parshall et al. | 104/130.01 |
| 3,247,890 | * | 4/1966 | Mihirogi | 104/130 |
| 3,812,788 | | 5/1974 | Laurent . | |
| 4,090,452 | * | 5/1978 | Segar | 104/247 |
| 4,354,434 | * | 10/1982 | Dehne | 104/103 |
| 4,596,192 | | 6/1986 | Forster . | |
| 4,888,454 | | 12/1989 | Scarpatetti et al. . | |
| 5,219,395 | * | 6/1993 | Spieldiener et al. | 104/130 |
| 5,247,890 | * | 9/1993 | Mihirogi | 104/130 |
| 5,823,114 | | 10/1998 | Cioleeti et al. . | |
| 5,845,581 | * | 12/1998 | Svensson | 104/120 |

OTHER PUBLICATIONS

Photograph showing Montreal Urban Community Transit Commission Subway car truck.

* cited by examiner

*Primary Examiner*—S. Joseph Morano
*Assistant Examiner*—Frantz F. Jules
(74) *Attorney, Agent, or Firm*—Frank J. McGue

(57) ABSTRACT

A mechanism is disclosed for actuating a switch guide beam swinging laterally between two or more fixed guide beam ends, in order to make a route selection for a beam guided vehicle. The moving guide beam pivots distantly of the primary fixed guide beam end to create a gap spanned by an intermediate suspended channel plate guide segment that provides substantially two equal lateral deflections to the moving vehicle for a route diversion in a storage yard or repair shop area. The mechanism for high speed or main line operation has two additional channel plate guide segments slidably guided at each end of the guide segment centrally affixed on the straddle beam and pivoted at the primary beam fixed end and the merge point on the radially moving swing guide beam to provide four substantially equal lateral deflections to the moving vehicle when a route diversion is required. The aggregation of moving guide beam elements mounted above the wheel rolling surface is actuated to select a route change by a geared motor driven sprocket mounted under the swing beam structure engaging a passive chain radially secured slightly below the wheel travel surface near the extreme end of the swing guide beam to align it with the selected fixed secondary guide beam end. To achieve substantially equal angular deflections of curvature, the proportions of the elements are function values of one, two and four.

3 Claims, 2 Drawing Sheets

BEAM SWING BEARING

ROLLER (±)12"
(CLEAN UP)
2 WAY (Y)
3 WAY
TURNOUT (SWITCH) TYPES
R.H.
L.H.

ACTUATING MECHANISM FOR A TRANSIT VEHICLE GUIDE BEAM SWITCH

TECHNICAL FIELD

This invention relates in general for switching and routing electrically and mechanically powered public transit car systems, and, more particularly, to a radially actuated guide beam mechanism for routing electrically powered and self-powered vehicles to and from dispatcher selected guide beam rollways.

BACKGROUND OF THE INVENTION

Many electrically powered rail vehicles are in existence today, from Montreal's rubber tired Metro to New York's subway, which use the common turn-out switch mechanism seen, for example, in any railroad terminal. In general, present day systems using heavy steel, four wheeled bogies with large, slow speed integral motors as the driving mechanism thereof require steering and guidance of such systems through switches which induce intense forces by the interaction of the steel flanged wheels against the steel rails or, on existing rubber tired vehicles having four wheeled bogies, by guide flanges or side rollways. Use of such mechanisms requires a large investment in infrastructure to support these great incurred steering forces safely.

Many Asian nations and Disney World are employing top of guide beam riding rubber tired vehicles, having exposed electrical conductors mounted on the sides of the beam. Consequently, the switching mechanism is massive and costly, because the guide beam is also the vehicle weight carrier.

This large investment is further complicated by the need to provide heavy sub-structures and mechanisms when directing such vehicles from one track to another for a route diversion. It is desirable, for passenger comfort, to minimize the angular displacements required for such shifts.

As disclosed in applicant's co-pending application Ser. No. 09/170,729, a guide mechanism provides an independent trolley plate system for steering and directing a transit car as it follows the guide beam. However, there is a need for a mechanism to direct vehicles from one guide beam track to another.

None of the known prior art disclose the guide beam routing system having a proportional leverage mechanism for accomplishing a simple series of equal angular deflections as set forth herein.

The present invention as delineated meets that need.

SUMMARY OF THE INVENTION

It is an object of this invention to provide a light weight public transit vehicle travel system which employs a novel mechanism for switching beam guided vehicles when a route diversion or conversion is required.

It is a further object of this invention to provide a guide beam routing mechanism for a light weight transit vehicle system which reduces cost and operates safely and reliably with a reduced infrastructure investment.

It is also a further object of this invention to provide a formula for proportioning the multiple guide segments to accomplish a smooth and equal incremental rate of equal angular deflections of the vehicle.

Further objects and advantages of the invention will become apparent as the following description proceeds and the features of novelty which characterize this invention will be demonstrated with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figures 1A, 1B, 1C, 3, 4, 5, 6, 7:
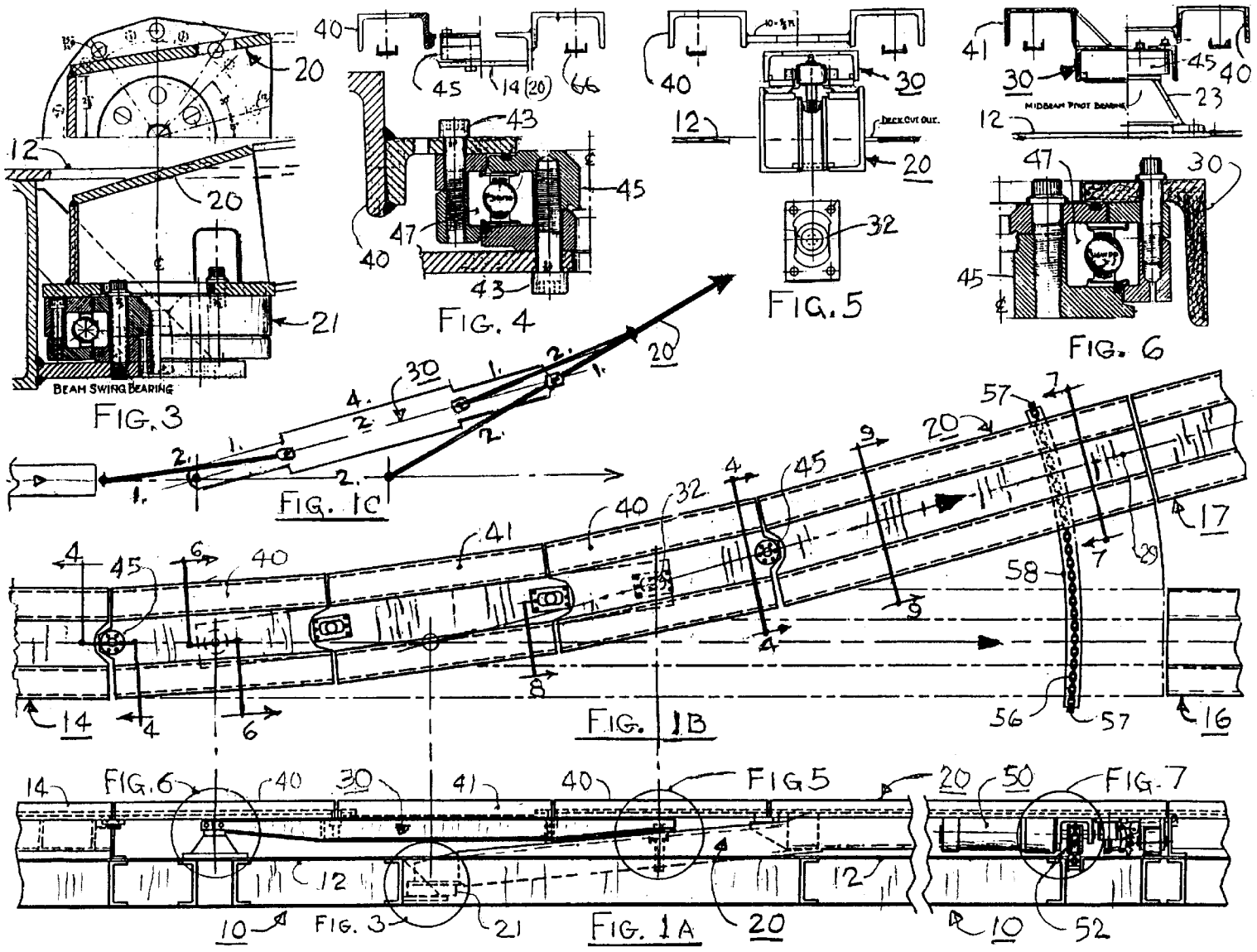
FIG. 1A is an elevation of a four deflection switch.
FIG. 1B is a plan view showing three intermediate channel plate guide segments.
FIG. 1C is a schematic view showing the geometric and functional proportions.
FIG. 3 shows details of the swing guide beam pivot bearing.
FIG. 4 shows a detail of the primary end bearing and channel plate mounting.
FIG. 5 shows a detail of the sliding pivot bearing of the straddle beam and the moving guide beam merge point.
FIG. 6 shows a detail of the straddle beam pivot bearing and mounting near the primary end.
FIG. 7 shows a detail of the passive chain drive to actuate the swing guide beam.

The present invention comprises a mechanism having five basic elements which, in combination, perform the diversion of a beam guided transit vehicle through a switch for a route selection. The basic elements are first, a structural frame 10 with a surface plate 12 serving as the deck for the vehicle wheels rollway. Second, a swing guide beam 20 radially pivoted to provide continuity of vehicle guidance between a primary fixed guide beam end 14 and one of several secondary fixed guide beam ends 16 and 17. Third, a straddle beam 30 that automatically controls the required equal angular displacement of suspended channel plate guide segments 40 and a center guide segment 41 attached and pivoted between each other and primary fixed guide beam end 14 and a pivot bearing 44 on swing guide beam 20. Fourth, suspended channel plate segments 40 and center guide segment 41 affixed to straddle beam 30 and the typical arrangement on all guide segments 40, 41 of electrical conductors 66. Lastly, a gear motor 50 driving a sprocket 52 that engages a passive chain 56 secured at both ends 57 in a radial slot 58 in surface plate 12.

As best seen in FIGS. 1A and 1B, the total mechanism, in combination, is assembled as a unit to provide a single entity for shipment to, and erection at, its position in the travel infrastructure of the beam guided vehicle transit system. Structural frame 10 combines surface plate 12 and primary fixed guide beam end 14 and secondary fixed guide beam ends 16 and 17, a swing beam radial pivot bearing 21 best seen in FIG. 3, depressed in an opening in surface plate 12 thereby preventing vehicle electric contact interference, a pivot bearing pedestal 23 best seen in FIG. 6, and passive chain 56, radial slot 58, a position indicating signal mast mounting (not shown) and limiting loops (not shown).

Figures 2A, 2B, 3, 7, 8, 9, 10:
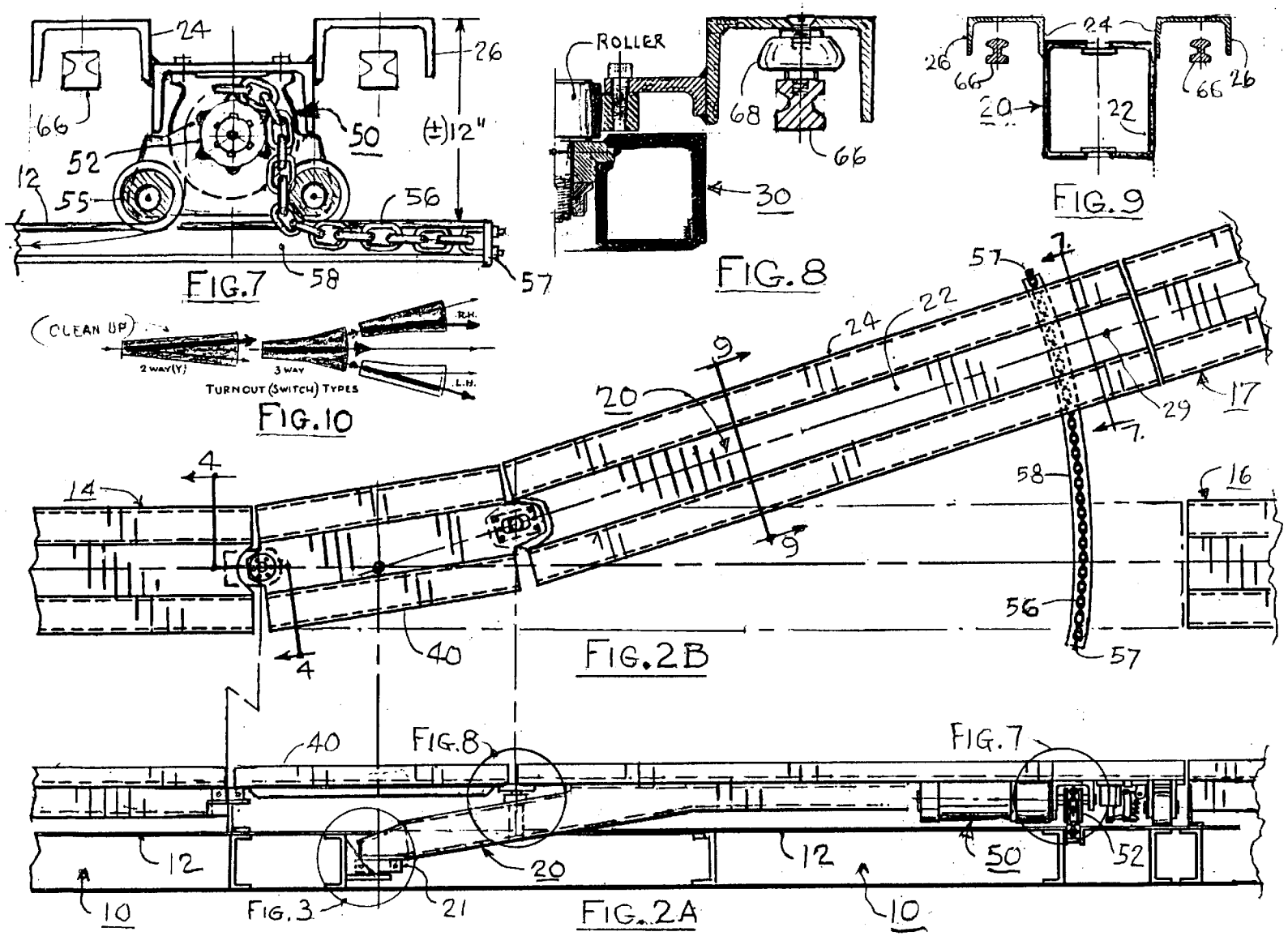
FIG. 2A is an elevation of a two deflection switch.
FIG. 2B is a plan view showing the suspended channel plate guide segment.
FIG. 8 shows a detail of the sliding guide bearing on the swing beam, also showing conductor mounting and insulation.
FIG. 9 shows a detail of the guide bars mounted on the swing beam structure.
FIG. 10 shows a diagram of four variations of standard components mounted on specific structural base plates.

As best seen in FIGS. 1A and 1B, swing guide beam 20 comprises a T-shape best seen in FIG. 9 which includes a hollow rectangular weldment 22 as the leg of the T-shape. Swing guide beam 20 is slidably mounted above surface plate 12 and pivoted as best seen in FIG. 3. Hollow rectangular weldment 22 extends along the direction of travel and provides mountings for one or more power supplying electrical conductors 66 and other mechanisms as described below. Extending laterally from weldment 22 are opposing members 24 forming the arms of the T-shape. Opposing members 24 are generally an inverted structural U-shape whose legs comprise flanges 26. Suspended for weather and safety protection behind each flange 26 is power supplying electrical conductor 66 secured by an insulator 68. Power supplying electrical conductor 66 is in electrical communication with power cables (not shown) within structural frame 10 which provides electrical energy to the system. This T-shaped mechanism is subject to the present inventor's co-pending application Ser. No. 09/170,729 which is herein incorporated by reference.

One end of each channel plate guide segment 40 is slidably connected to a center guide segment 41 centrally affixed to straddle beam 30 as seen in FIG. 8 or the end of primary fixed guide beam 14 or swing guide beam 20 by a typical pivot bearing 45. As best seen in FIG. 4, one type of pivot bearing 45 employed includes an enclosed ball bearing 47 secured to primary fixed guide beam end 14 via bolts 43 and channel plate guide segment 40. The same pivot bearing 45 is employed between swing guide beam 20 and channel plate guide segment 40.

Swing guide beam 20 and suspended channel plate guide segments 40 are activated for a route selection by gear motor 50 driving sprocket 52 that engages a passive chain 56 anchored at both ends 57. Gear motor 50 and sprocket 52 secured within and near an end 29 of swing guide beam 20 as best seen in FIG. 7. Passive chain 56 is positioned in a depressed radial slot 58 in surface plate 12 in an arc corresponding to the radial movement of swing guide beam 20. Chain 56 is lifted from and returned to radial slot 58 to engage drive sprocket 52 by guide rollers 55. Those skilled in the art will recognize that many other actuating means are possible besides the chain/sprocket combination described above.

The simple two deflection mechanism shown in FIGS. 2A and 2B is identical in all components as in the above description, but does not incorporate straddle beam 30 and one of the suspended channel plate guide segments 40 and center guide segment 41.

The preferred embodiment as best seen in FIG. 1A and 1B comprises a system of proportional linkages as best seen in diagram FIG. 1C to make equal angular deflections of the two suspended channel plate guide segments 40 with respect to their adjacent pivot members 14, 20 and 41. As the swing guide beam 20 is activated, it leaves the straight through or main line of travel position from secondary fixed guide beam end 16 and rotates to align with the turn-out secondary fixed guide beam end 17. In the illustrated example, straddle beam 30 causes the suspended channel plate guide segments 40 to deflect equally because their proportional functional lengths are multiples of two, twice the basic dimension establishing the unit distance one of the pivot bearing pedestal 23 spaced from the primary fixed guide beam end 14. The swing guide beam radial pivot bearing 21 is spaced from the pivot bearing pedestal two functional units therefrom. The straddle beam 30 carrying center guide segment 41, whose functional length is two, has a functional length of four. Thus, the angle of deflection between primary fixed guide beam 14 and straddle beam 30, and the angle between straddle beam 30 and swing guide beam 20 are all equal. The system is not limited to the illustrated example. Thus, the many switches involved in a station area might constitute functional values of 1, 2, 4. High speed main line switches might use functional values of 3, 6, 12, etc.

As best seen in FIG. 10, the present system can be utilized in a No. of different configurations, ranging from the 2-way (i.e. two secondary fixed end guide beams 16 and 17) systems described in detail above, to a three way system (i.e. three secondary fixed end guide beams), to various right and left handed systems utilizing the basic geometric function proportions designated on the individual elements shown in FIG. 1C. Combinations of the common standard elements into various configurations are possible to allow dispatchers to route the transit vehicles as needed.

Although only certain embodiments have been illustrated and described, it will be apparent to those skilled in the art that various changes and modifications may be made therein without departing from the spirit of the invention or from the scope of the appended claims.

What is claimed is:

1. An articulated switch mechanism for routing rubber tired vehicles between a fixed primary guide beam end and a plurality of fixed secondary guide beam ends, the articulated switch mechanism comprising:

a structural base frame having a planar top surface plate; a structural T-shaped swing guide beam pivoted below and swinging above the planar top surface plate to select one of the plurality of fixed secondary guide beam ends; a straddle beam pivoted on a frame mounted pedestal located distantly from the primary fixed end guide beam, and slidably pivoted at a merge point of the straddle beam on the structural T-shaped swing guide beam;

a plurality of channel plate guide segments, one of the plurality of channel plate guide segments centrally affixed to the straddle beam, two intermediate suspended channel plate segments, one pivoted at the primary fixed guide beam end, the other segment hinged at a merge point of the other segment on the centerline of the structural T-shaped swing guide beam and both slidably pivoted at their attachment to the centrally affixed channel plate guide segment on the straddle beam, wherein the proportions of the several suspended guide segments and the straddle beam are determined in substantially equal increments of the functional ratios of 1, 2, and 4 and multiples thereof;

electromotive actuating means secured under the radially moving end of the swing guide beam to propel said beam to a chosen secondary fixed end guide beam; and support means for mounting electric contact conductors under all guide beam segments for weather and safety protection.

2. The articulated switch mechanism of claim 1 wherein the actuating means comprises a passive chain anchored at both ends of an arcuate slot conforming to radial travel of the swing guide beam, a motor driven sprocket mounted within the swing guide beam structure, the sprocket engaging the passive chain to propel the swing guide beam along the arc into alignment with the selected secondary fixed guide beam end.

3. An articulated switch mechanism for routing rubber or composition tired vehicles between a fixed primary guide beam and a plurality of fixed secondary guide beams, the articulated guide mechanism comprising:

a structural platform, a swing guide beam structure having one end pivoted at the platform, the other adapted to align with the ends of a plurality of fixed secondary guide beams along an incremental arc, a ratio integrating straddle beam guide segment, one or more suspended channel plate guide segments pivotally mounted and interposed between the ratio integrating straddle beam guide segment and the primary fixed guide beam end, and the swing guide beam structure, the suspended guide segments having a corresponding No. of pivots mounted at the centerline of abutting ends of the ratio integrating straddle beam guide segment of the primary guide beam and the swing guide beam structure, the one or more guide segments, the primary guide beam end and the swing guide beam structure being separated by a corresponding number of suspended channel plate guide segments, one end of the swing guide beam structure pivotally mounted below the midpoint of the straddle beam guide segment and the other end is adapted for locking alignment with a selected secondary fixed guide beam end, and a passive chain anchored at both ends thereof along the arc, a motor driven sprocket mounted within the swing guide beam structure, the sprocket engaging the passive chain to move the swing guide beam structure along the arc to align the extreme end of the swing guide beam structure with a selected one of the plurality of fixed secondary guide beam ends, the swing guide beam structure actuating the straddle beam guide segment to distribute the angular displacement of the one or more suspended channel plate guide segments in equal increments from zero degrees when in the main line position to the sum of equal angular deviations subtended by the gross angle of the swing guide beam structure when locked in alignment with the selected one of the plurality of fixed secondary guide beam ends.

* * * * *